United States Patent [19]

Willis

[11] 4,160,334

[45] Jul. 10, 1979

[54] REVERSIBLE PAGE TURNER

[75] Inventor: Gordon Willis, London, England

[73] Assignee: Symot Limited, Oxon, England

[21] Appl. No.: 849,768

[22] Filed: Nov. 9, 1977

[30] Foreign Application Priority Data

Nov. 9, 1976 [GB] United Kingdom ..... 46653/76

[51] Int. Cl.[2] ..... G09F 11/00

[52] U.S. Cl. ..... 40/531; 84/487

[58] Field of Search ..... 40/531, 343; 84/486, 84/487

[56] References Cited

U.S. PATENT DOCUMENTS

| | | | |
|---|---|---|---|
| 2,176,483 | 10/1939 | Barron | 40/531 |
| 2,540,244 | 2/1951 | Campbell | 40/531 |
| 3,570,154 | 3/1971 | Cosenza | 84/487 |
| 3,939,587 | 2/1976 | Weststrom | 40/531 |
| 4,031,644 | 6/1977 | Rogers | 40/531 |
| 4,102,071 | 7/1978 | D'Arcy | 40/531 |

*Primary Examiner*—Louis G. Mancene
*Assistant Examiner*—Paul J. Hirsch
*Attorney, Agent, or Firm*—Wender, Murase & White

[57] ABSTRACT

A page turner capable of turning the pages of a book forwards or backwards which includes a roller mounted on a mounting above a book support. The mounting is movable relative to the support so that the roller can engage pages on either side of a book spline. The roller is rotatable in opposed senses and is operable so as to displace a page to be turned under the roller to release the page and a flap carried on the mounting alongside the roller is movable relative to the support to move the released page to the opposite side of the book spline.

17 Claims, 14 Drawing Figures

REVERSIBLE PAGE TURNER

BACKGROUND OF THE INVENTION

This invention relates to page turners, that is devices in which a book or document to be read is placed and the device is operable to turn over the pages for the reader. Such devices are particularly suitable for use by handicapped persons who would otherwise be unable to read a book without the assistance of another person to turn the pages over for them.

A disadvantage of the known page turners is that they are operable to turn the pages of a book forwards only. Thus the reader is unable to turn back the pages to re-read an earlier section of the book. Furthermore if two or more pages are simultaneously turned over the reader cannot turn back the page or pages to the correct position in the book. In both instances it would be necessary to obtain the assistance of another person to remove the book from the device, turn back the pages to the right place and re-load the book in the device. This is annoying for the reader especially where the availability of such other persons is restricted.

It is an object of the present invention to provide a page turner which substantially overcomes the above described disadvantage of known page turners.

SUMMARY OF THE INVENTION

According to the present invention we provide a page turner comprising a support for a book, means for holding the book open, a roller mounted above the support and arranged and adapted to engage in a first position a first page lying on one side of the book spline and movable to a second position to engage a second page lying on the opposed side of the book spline, a mounting carrying the roller, means for moving the mounting with the roller between said first and second positions, means for driving the roller in opposed senses so that in use when the roller is in said first position rotation in one sense displaces the first page under the roller and releases the first page and when the roller is in said second position rotation in the opposite sense displaces the second page under the roller and releases the second page, a flap carried on the mounting, the flap extending alongside the roller, means for moving the flap relative to the support so that in use the flap moves a released page to the opposed side of the book spline and control means for controlling the mounting moving means and the roller drive means.

Preferably the mounting is pivotal relative to the support between the first and second positions and the mounting moving means comprises a reversible electric motor coupled to an output shaft which in turn is connected to the mounting.

Conveniently the roller is mounted on an axle for rotation with the axle and the axle is journalled for rotation to the mounting. The roller drive means preferably comprises a reversible electric motor coupled to an output shaft which in turn is connected to the roller axle by drive transmitting means.

Preferably the flap is connected to the roller axle by a friction drive so that the roller moves angularly with the axle but if movement of the flap is prevented or restricted the friction drive slips allowing the axle to rotate. The flap is made of a transparent or translucent material so that when the flap overlies a page to be read the print is visible through the flap and can be easily read.

The control means conveniently comprises manually operable switch means for controlling actuation of the reversible electric motors. Preferably the switch means comprises pneumatic pressure sensitive switch units operable by a suitable device such as an air bellows or suck/blow device.

In operation of the page turner, the roller and flap engage a page to be turned, the roller is rotated in one sense to displace the page under the roller and to release the page, the friction drive slipping to allow rotation of the roller relative to the flap. The roller is then rotated in the opposite sense and the flap moves angularly with the roller axle through the friction drive to engage the released page, move it to and hold it in position on the opposed side of the book spline. The reader can then read the reverse face of the page which has been turned over. When the reader has read the reverse face the mounting together with the roller is pivoted to engage the reverse face, the roller is then rotated and the flap moves to engage and hold the following page in position for reading.

The mounting together with the roller can be disposed on either side of the book spline so that by controlling the movement of the mounting and the rotation of the roller the reader can turn pages forwards or backwards as desired thus overcoming a major disadvantage of known page turners. Furthermore pages lying on either side of the book spline can be read so that the page turner is not restricted to books having print on one side of the pages only.

BRIEF DESCRIPTION OF THE DRAWINGS

The invention will now be described in more detail, by way of example only, with reference to the accompanying drawings wherein.

DESCRIPTION OF THE PREFERRED EMBODIMENTS

Figure 1:
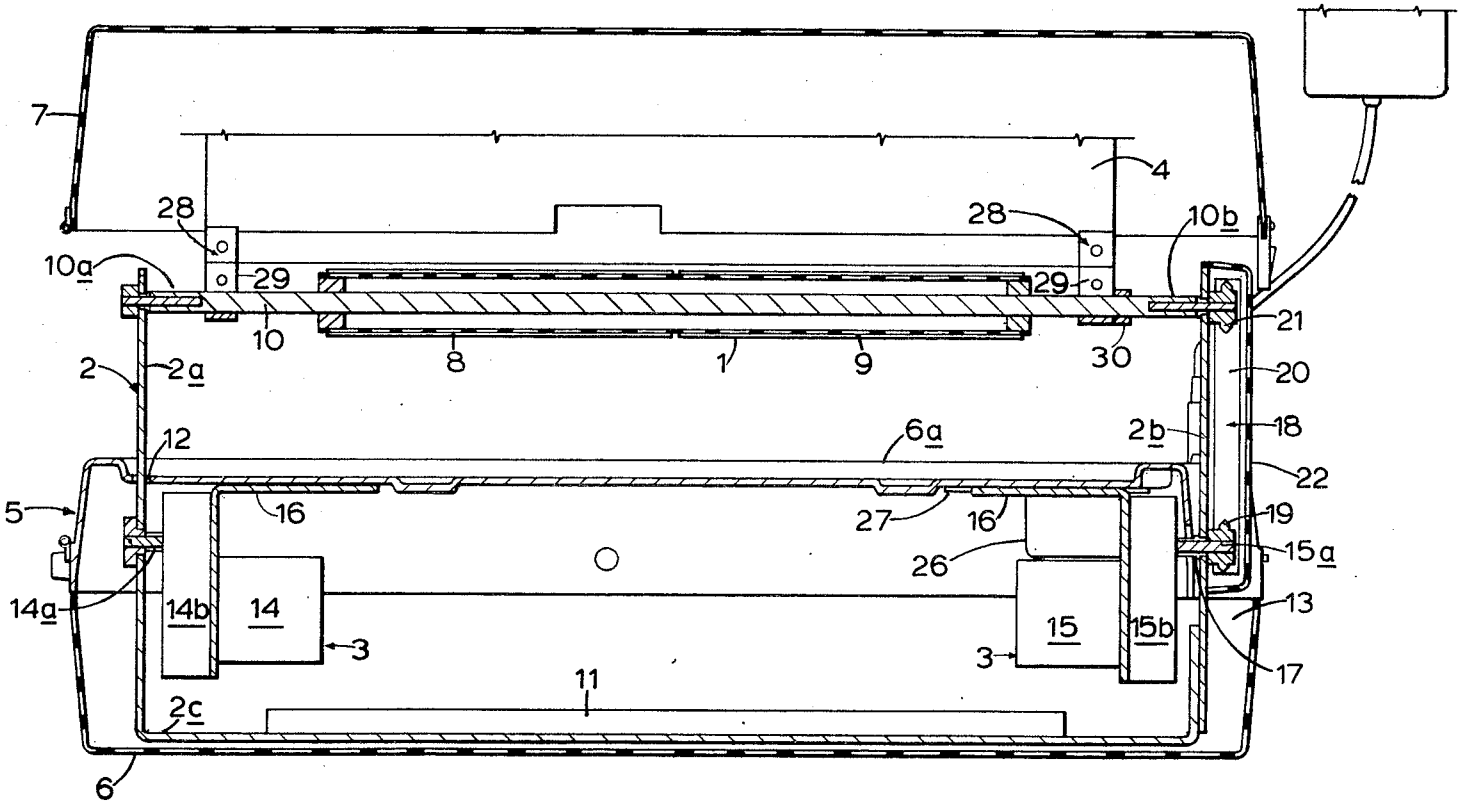
FIG. 1 is a part vertical section through a page turner.
Figure 2:
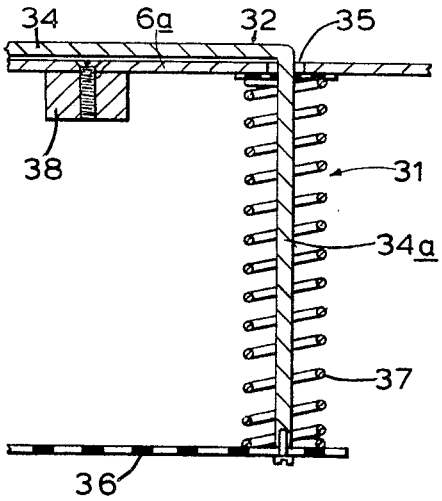
FIG. 2 is a section through part of the retaining means for locating and securing a book in position.

The page turner shown in the accompanying drawings comprises a roller 1 carried on a support frame 2, drive means 3, and a flap 4. The page turner is mounted in a portable case 5 moulded from a suitable plastics material. The case 5 has an elongate hollow base 6 of generally rectangular section and a cover or lid 7. The lid 7 is detachable from the base. The base provides a support surface **6*a*** for a book which is to be read.

The roller comprises two elongate cylindrical rolls 8, 9 having a surface made of a plastics material which has a high coefficient of friction relative to paper, for example a suitable material is that sold under the Trade Mark "DYCEM". The rolls 8, 9 are mounted on a common axle 10 for rotation with the axle 10. The axle is carried by the support frame 2 which is of generally U-shaped outline and comprises arms **2*a*, 2*b* connected by a bridge piece 2*c*. The bridge piece 2*c* is located within the base 6 and carries a counterweight 11. The arms 2*a*, 2*b* project through elongate slits 12, 13 respectively formed in the base. One end 10***a* of the axle is journalled for rotation to the free end of arm 2*a* and the other end 10*b* is journalled for rotation to the free end of arm 2*b*.

The drive means comprises two electric motors 14, 15. Each motor is located within the base 6 and supported by a respective mounting bracket 16 secured to the base. The base includes a socket for connecting the motors to an external power source. When such external power source is connected it may be necessary to use a transformer to step down the voltage. Motor 14 is coupled to a driven output shaft 14*a* through a gearbox 14*b* and shaft 14*a* is drivingly connected to the arm 2*a*. Motor 15 is coupled to a driven output shaft 15*a* through a gearbox 15*b*. Shaft 15*a* extends through a bearing 17 mounted in an opening in the arm 2*b* and is drivingly connected to the free end 10*b* of the axle by drive transmitting means 18. The drive transmitting means comprises a sprocket 19 mounted on the output shaft 15*a* connected by a toothed belt 20 to a sprocket 21 mounted on the free end 10*b* of the axle. The drive transmitting means is protected by a cover 22 mounted on the arm 2*b*. The output shafts from the motors are axially aligned and provide two fixed pivots which carry the support frame 2. The frame 2 is pivotal about the fixed pivots in response to actuation of the motor 14 and the roller 1 is rotatable in response to actuation of the motor 15.

The drive to each motor is reversible and is controlled by switch means 23 which comprises two pressure sensitive pneumatic switch units, generally indicated by reference numerals 24, 25 in FIGS. 7 to 14. The switch units are arranged within a housing 26 supported by a switch plate 27 within the base 6. Each pneumatic switch unit has two switch positions, one for actuating motor 14 and one for actuating motor 15, defined by pressure sensitive micro switches (hereinafter referred to as microswitches 24A, 24B and 25A, 25B respectively). Each switch unit has an associated manually operable control device (not shown) for example an air bellows or a suck/blow device for actuating the micro-switches. Micro-switch 24A actuates motor 15 so as to rotate the axle 10 and rolls 8, 9 in one sense and micro-switch 25A actuates motor 15 so as to rotate the axle 10 and rolls 8, 9 in the reverse sense. Micro-switch 24B actuates motor 14 so as to pivot the support frame 2 in one direction relative to the base and micro-switch 25B actuates motor 14 so as to pivot the support frame 2 in the reverse direction relative to the base. Sequential operation of the micro-switches to control the actuation of motors 14, 15 allows a page to be turned forwards or backwards in a manner to be described in more detail later.

The flap 4 is of oblong rectangular outline and is made from a transparent or translucent plastics material. The flap 4 is connected to the axle 10 by two friction bearings 28 which provide a friction drive. Each bearing is rigid with the flap 4 and comprises a plastics bush 29 which encircles the outer surface of the axle. The flap extends alongside the roller and is axially adjustable relative to the roller by means of an adjustable bush 30 mounted on the axle 10 which engages one of the friction bearings 28. The friction drive through the bearings 28 is such that the flap 4 moves angularly with the axle 10 when the latter rotates but, if movement of the flap is restricted or prevented the friction drive slips to allow the axle to rotate.

Retaining means 31 comprising two spring-loaded clamps 32, 33 is provided for locating and securing a book to be read in the correct position. Both clamps extend generally in the same direction as the roller 1 and are arranged on opposite sides of the axis defined by the fixed pivots for the support frame 2. Each clamp comprises an elongate member 34 made from metal strip and engageable with the support surface 6*a*. The end portions 34*a* of each member are cranked to project through respective openings 35 formed in the support surface 6*a*. The free ends of each member are connected by a respective contact bar 36 made from a magnetic material. Respective compression springs 37 act between the inner surface of the support face 6*a* and the free ends of the members to urge the clamps into engagement with the support surface. Two permanent magnets 38 are mounted on the inner surface of the support face 6*a*. One magnet is provided for each clamp and is arranged to engage the contact bar 36 of the associated clamp when the latter is raised so as to retain the clamp in the raised position against the spring biassing to allow insertion of the book to be read. In a modification the magnets and magnetic contact bars are replaced by spring clips and connecting members having a portion of circular section engageable with the associated spring clip.

The base 6 is provided with a support stand (not shown) including a fixed leg and an adjustable leg. Each leg comprises a U-shaped member having two arms connected by a bridge piece which in use engages the surface on which the base stands. The arms of the fixed leg are located in a peripheral groove formed in the side wall of the base and the free ends of the arms are connected to the adjacent free ends of the arms of the adjustable leg. The adjustable leg is pivotal relative to the fixed leg and a respective control knob is provided at each pivotal connection for locking the adjustable leg in any selected position so that the attitude of the support surface 6*a* on which the book is placed can be altered as desired.

Figure 3:
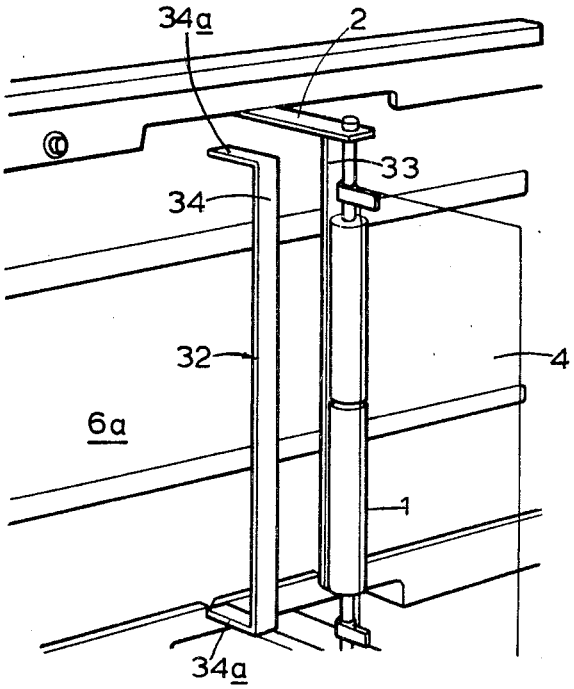
FIGS. 3 to 6 show the operating sequence for locating and securing a book in position.
Figure 4:
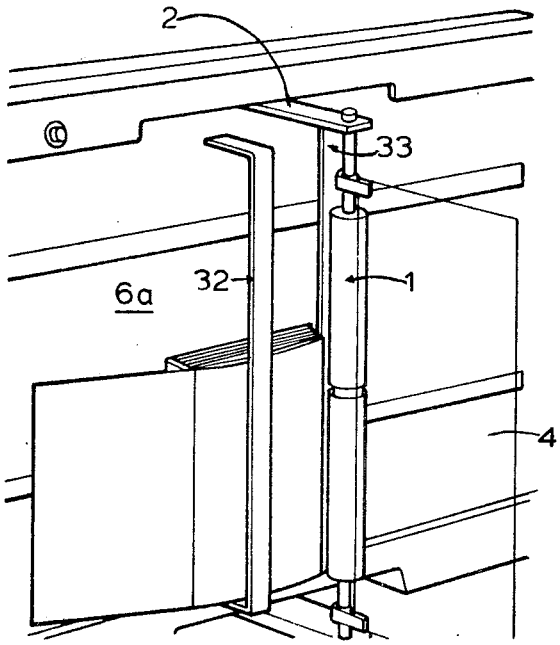
Figure 5:
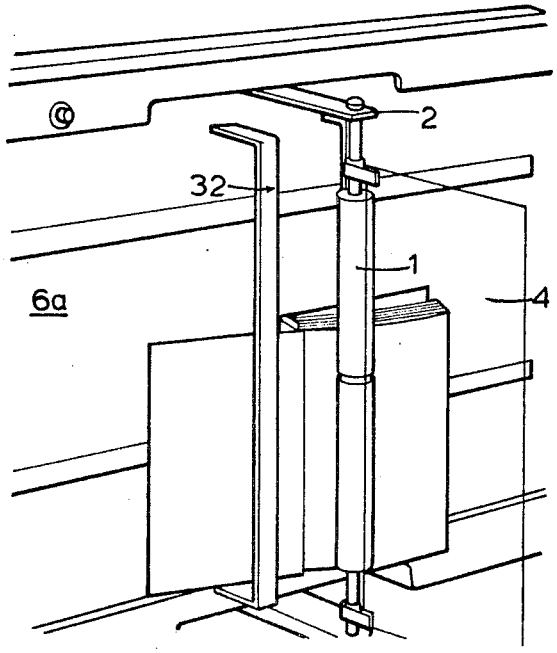
Figure 6:
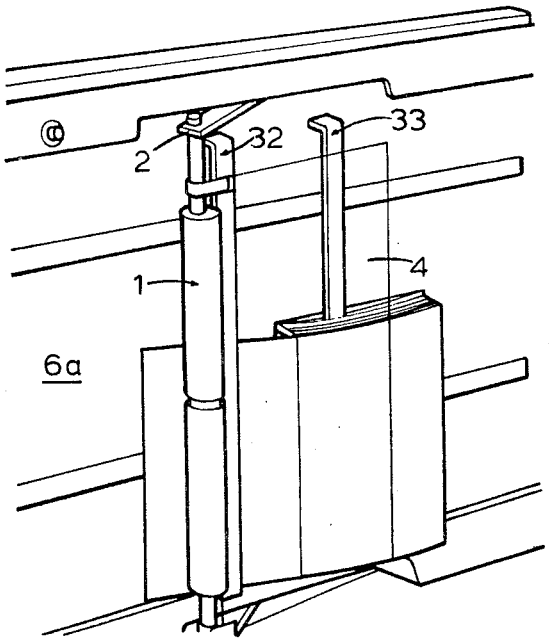
Figure 7:
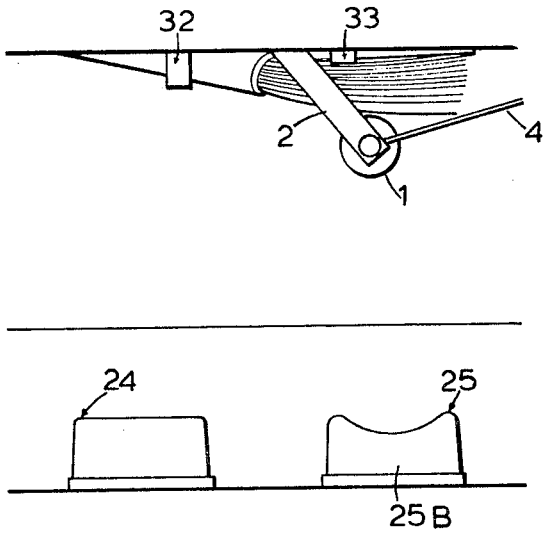
FIGS. 7 to 12 show the operating sequence for one complete page turning cycle including the switch control means.
Figure 8:
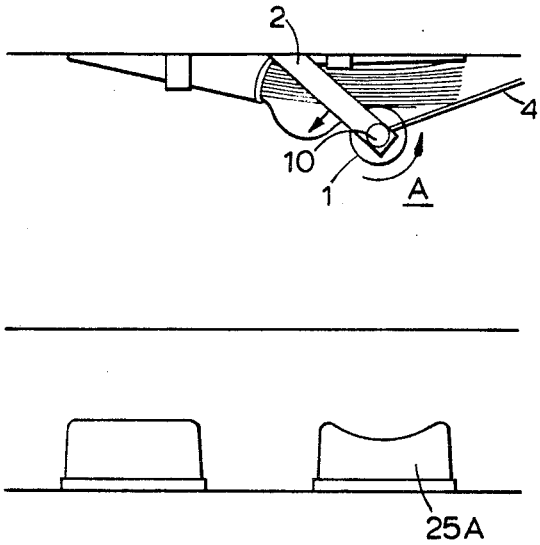
Figure 9:
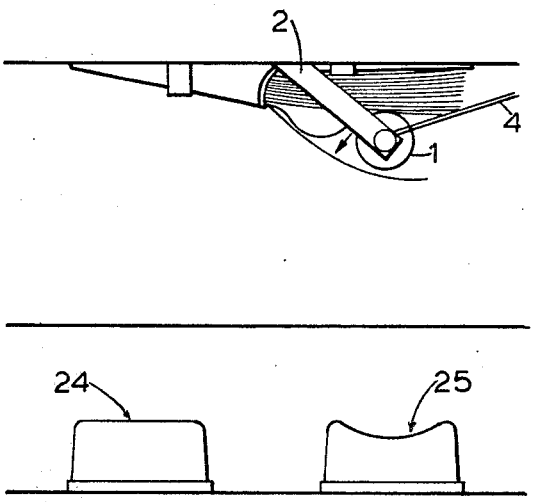
Figure 10:
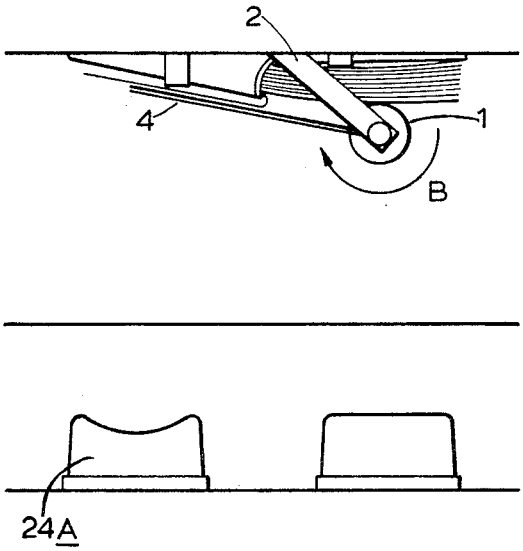
Figure 11:
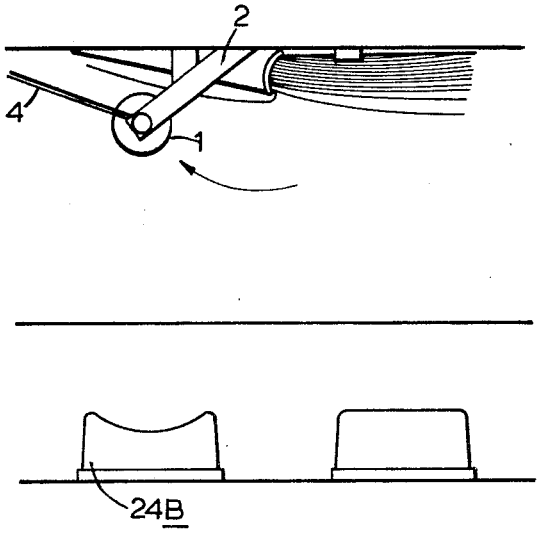
Figure 12:
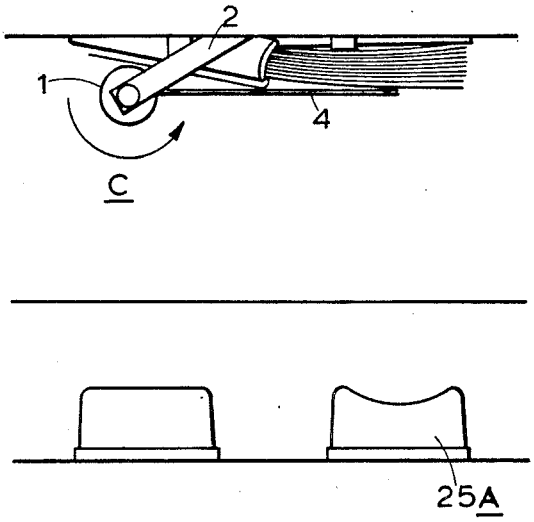
Figure 13:
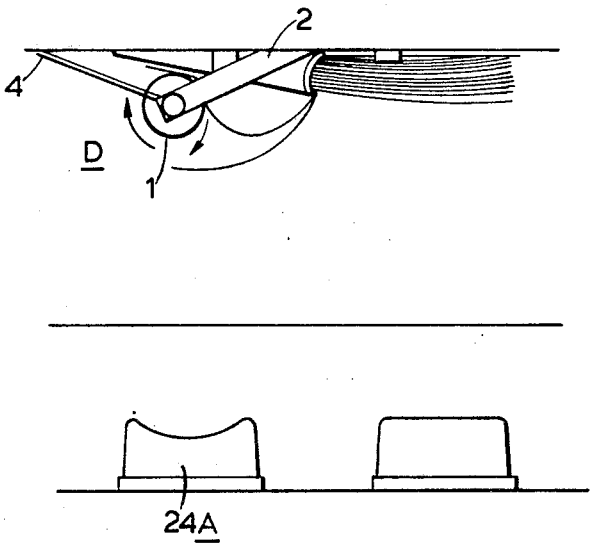
FIGS. 13 to 14 show the operating sequence for turning a page backwards.
Figure 14:
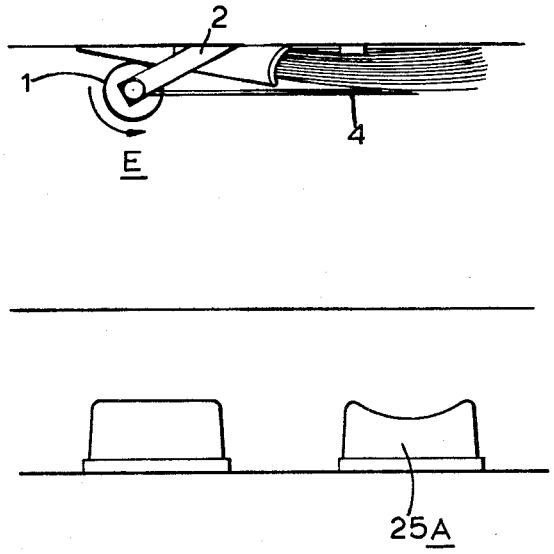

Loading and operation of the page turner is as follows, starting from the position shown in FIG. 3 with clamp 32 held in its raised position, an open book is slid under the raised clamp and passes below the raised roller 1 as shown in FIG. 4. The other clamp 33 is raised to allow one half of the cover to pass below. The book is moved until the spine is aligned with the axis defined by the fixed pivots of the support frame 2. The clamp 32 is released and under the influence of its spring biassing engages the other half of the cover so that the book is secured in position. The roller 1 is lowered to the position shown in FIG. 6 with the flap 4 lying on the right hand pages to hold the pages flat in position. The book is now loaded and the page turner set for operation by the user. When the user has read the right hand page and wishes to turn the page over he first actuates microswtich 25B which actuates motor 14 to move the support frame 2 and the roller 1 from the initial position shown in FIG. 6 to the position shown in FIG. 7 in which the roller engages the uppermost right hand page. The user then actuates micro-switch 25A which actuates motor 15 to rotate the axle 10 and roller 1 in the direction of the arrow A shown in FIG. 8 causing the top page to turn back on itself until the page is released and adopts an intermediate position shown in FIG. 9. During this operation the flap 4 is urged in the direction of rotation of the axle to press against the remaining pages to hold same in position and the friction drive slips to allow the axle 10 to rotate relative to the flap. The user then actuates micro-switch 24A which reverses the drive from motor 15 to rotate the axle 10 and roller 1 in the opposite sense as indicated by the arrow B in FIG. 10. The flap is now free to move anguarly with the axle under the control of the friction drive and engages the released page, moves it to and holds it in the final position on the other side of the book spline. The user can now read the reverse face of the page which has been turned over. To read the next right hand page the user actuates micro-switch 24B which reverses the drive from motor 14 to move the support frame 2 and roller 1 from the position shown in FIG. 10 to the position shown in FIG. 11. The user then actuates micro-switch 25A which actuates motor 15 to rotate the axle and rollers in the direction of arrow C in FIG. 12 to move the flap to the position shown, clamping the right hand pages in position to allow the user to read the uppermost right hand page. During this movement the roller tends to draw the previously turned over page further over to ensure that the page is entirely clear of the print on the right hand page which is to be read. Further pages can be turned over by repeating the above cycle. However if the user wishes to turn a page backwards then starting from the position shown in FIG. 13 the user would first actuate micro-switch 24A which actuates motor 14 to rotate the axle 10 and roller in the direction of arrow D to move the left hand page back on itself until the page is released. The user would then actuate micro-switch 25A which actuates motor 14 to rotate the axle and roller in the opposite sense as indicated by arrow E in FIG. 14. The flap 4 moves angularly with the axle under the control of the friction drive to engage the released page, move it to and hold it in the final position on the other side of the book spline.

It will be appreciated that the above-described page turner allows the user to turn pages either forwards or backwards and to read pages lying on either side of the book spline without covering any of the print on the page being read.

The page turner may be modified in a number of ways, for example the drive transmission means may comprise a simple belt/pulley drive or a pinion on the output shaft 15*a* engageable with a pinion on the axle 9. When the drive transmission means uses pinions an idler gear train may be provided between the driven pinion and the axle pinion.

Furthermore the pneumatic switch units and the control devices therefor may be replaced by any other suitable switch units and/or control devices known to those skilled in the art, for example the control device may comprise a joy stick movable in different directions to allow sequential operation of the motors whilst separate switch units may be provided to control both the forward and reverse drives for each motor. The page turner may be mounted in other locations such as a desk or table rather than in a portable case. A separate motor may be provided for controlling movement of the flap to replace the friction drive, although with such an arrangement the flap would still be connected to the mounting, for example the flap may be connected to but freely rotatable relative to the roller axle. Furthermore, although the flap described and illustrated is of oblong rectangular outline this is only a preferred shape, thus the flap may comprise a plurality of fingers or rod-like projections connected to a common base member which is connected to the mounting, the power source for the electric motors may comprise battery means so that the page turner can be used when no mains power source is available. The bearings 28 may be secured to or formed integrally with the flap 4. Finally in some instances it may be possible to omit the counterweight 11.

I claim:

1. A page turner comprising a support for a book, means for holding said book open, a roller having an axis of rotation, said roller mounted above said support to engage in a first extreme position a first page lying on one side of the book spline and movable to a second extreme position to engage a second page lying on the opposed side of the book spline, a mounting carrying said roller such that said axis of rotation is maintained parallel to the book spline, means independent of engagement of said roller with the pages of said book for moving said mounting with said roller in an arcuate path from one of said first and second extreme positions to the other of said first and second extreme positions, means for driving said roller in opposed senses so that in use when said roller is in said first position rotation in one sense displaces said first page under said roller and releases said first page and when said roller is in said second position rotation in the opposite sense displaces said second page under said roller and releases said second page, a flap carried on said mounting, said flap extending alongside said roller, means for moving said flap relative to said support so that in use said flap moves a released page to the opposed side of the book spline and control means for controlling said mounting moving means and said roller drive means.

2. A page turner according to claim 1 wherein said roller has an outer contact surface made of a plastics material having a high coefficient of friction relative to paper.

3. A page turner according to claim 1 wherein said flap is made of a transparent or translucent material.

4. A page turner according to claim 1 wherein said book holding means comprises a pair of spring loaded clamps, one clamp being engageable with one half of the back cover to locate and secure said one half of the book cover in position, the other clamp being engageable with the other half of the book cover to locate and secure said other half of the book cover in position.

5. A page turner according to claim 1 wherein said mounting is mounted on a pair of fixed pivots for pivotal movement relative to said support between said first and second positions.

6. A page turner according to claim 5 wherein said mounting moving means comprises a reversible electric motor coupled to an output shaft connected to said mounting and said electric motor is operable through said control means to effect said pivotal movement of the mounting.

7. A page turner according to claim 6 wherein said roller drive means comprises a reversible electric motor coupled to an output shaft connected to said roller through drive transmitting means and said electric motor is operable through said control means to rotate said roller in opposite senses.

8. A page turner according to claim 7 wherein said roller is mounted on an axle for rotation therewith, said mounting comprises a pair of spaced arms connected by a bridge piece and one end of said roller axle is journalled for rotation to the free end of one arm and the other end of said roller axle is journalled for rotation to the free end of the other arm.

9. A page turner according to claim 8 wherein said drive transmitting means comprises a sprocket on said output shaft of said roller drive means connected by a toothed belt to a sprocket on said roller axle.

10. A page turner according to claim 9 wherein said fixed pivots on which said mounting is pivotally mounted comprise the respective output shafts of said mounting moving means and of said roller drive means.

11. A page turner according to claim 10 wherein said flap moving means comprises a friction drive from said roller axle to said flap whereby said flap moves angularly with said roller axle.

12. A page turner according to claim 11 wherein said friction drive comprises a pair of friction bearings rigid with said flap and encircling said roller axle and each of said bearings comprises a respective bush made of a plastics material.

13. A page turner according to claim 12 wherein said control means for said mounting moving means and said roller drive means comprises manually operable switch means for actuating said reversible electric motors.

14. A page turner according to claim 13 wherein said manually operable switch means comprises two switch units, one switch unit controls movement of said mounting from said first position to said second position and rotation of said roller in one sense and said other switch unit controls movement of said mounting from said second position to said first position and rotation of said roller in the opposite sense.

15. A page turner according to claim 14 wherein each switch unit has two associated pneumatic pressure sensitive micro-switches defining separate switch positions, one switch position actuating said mounting moving means, the other switch position actuating said roller drive means.

16. A page turner according to claim 15 wherein said support comprises an elongate hollow base having a support surface for said book, said mounting moving means, roller drive means and control means are mounted within said base and said bridge piece is located within said base and said arms extend through elongate slits formed in said base whereby said roller and flap are arranged above said book support surface.

17. A page turner according to claim 16 wherein said support further comprises a cover for covering said roller and said flap, said cover being detachable from said base and an adjustable support stand for adjusting the angle of inclination of said book support surface relative to the surface of which said base is placed.

* * * * *